United States Patent [19]

Hattori et al.

[11] Patent Number: 4,804,284

[45] Date of Patent: Feb. 14, 1989

[54] RELOCATING CONTROL SYSTEM FOR A PRINTING APPARATUS

[75] Inventors: Hiroshi Hattori, Nagoya; Satoshi Shibata, Aichi, both of Japan

[73] Assignee: Brother Kogyo Kabushiki Kaisha, Aichi, Japan

[21] Appl. No.: 27,355

[22] Filed: Mar. 18, 1987

[30] Foreign Application Priority Data

Mar. 19, 1986 [JP] Japan ..... 61-63207

[51] Int. Cl.[4] ..... B41J 21/16

[52] U.S. Cl. ..... 400/279; 400/63

[58] Field of Search ..... 400/61, 63, 74, 76, 400/279, 695, 696, 697, 697.1

[56] References Cited

U.S. PATENT DOCUMENTS 4,618,275 10/1986 Brinkmann et al. ..... 400/279

FOREIGN PATENT DOCUMENTS 159378 9/1984 Japan ..... 400/279

*Primary Examiner*—David A. Wiecking

*Attorney, Agent, or Firm*—Barnes & Thornburg

[57] ABSTRACT

A printing apparatus is disclosed which moves a print head of a printing mechanism to a relocation position on receiving a relocation command signal.

On receiving a relocation command signal, a searching means retrieves a code data of a character or the like other than a space code in sequence from an end address toward a head address of a correction memory. Then, when the searching means detects code data of the character or the like, a controlling means relocates the print head at the print position which is shifted by one digit in the printing direction from the position corresponding to the address of the code data detected by the searching means.

12 Claims, 7 Drawing Sheets

RELOCATING CONTROL SYSTEM FOR A PRINTING APPARATUS

BACKGROUND OF THE INVENTION

The present invention relates to a printing apparatus and specifically relates to a printing apparatus wherein control of retrieving the relocation position when a print head is relocated is improved.

Conventionally, the electronic typewriters and the like are generally provided with a relocating function for returning a print head to an original position.

This relocating function is a function which returns the print head to the original print position from which printing is to be continued after making a corrective print of a wrongly printed character which is noticed during printing while inputting through a keyboard.

For example, in the Japanese Patent Publication (examined) No. 58-31315, and corresponding U.S. Pat. No. 4,252,451, there is disclosed a relocation controlling apparatus for a typewriter provided with a present position register storing the present position of a print element in one print line as a numeric value, a relocation register storing a maximum numeric value stored in this present position register and the like.

In this relocation controlling apparatus, the relocation position of the print element is stored in the relocation register, and data of the relocation register is always renewed for every change of the relocation position of the print element in response to printing operation.

However, in the relocation controlling apparatus mentioned in the above-described patent publication, data of the relocation register is renewed always in response to a movement of the print head even when the print head makes printing operation in the printing direction without making backspace, and therefore this controlling apparatus has a problem that the burden of a CPU (central processing unit) of the controlling apparatus is increased by that much, and the processing time int he CPU is extended.

SUMMARY OF THE INVENTION

The object of the present invention is to provide a printing apparatus which can relocate the print head by retrieving the relocation position only when performing relocation without the need of the relocation register.

As shown in a functional block diagram of FIG. 1, a printing apparatus in accordance with the present invention is provided with a printing mechanism printing characters, symbols and the like on a print paper corresponding to the inputted data, a correction memory storing this printed data correspond to the print position; and a present position memory storing the present position of a print head of the printing mechanism correspond to the print position. Additionally the printing apparatus includes a searching means for searching code data of a character or the like other than a space code in sequence from an end address toward the upper or higher address of the correction memory when receiving a relocation command signal from an inputting means, and a controlling means for relocating the print head of the printing mechanism to the print position corresponding to the address lower by one character than the address where the code data of a character or the like is first detected based on an output from the searching means and the data of the present position memory.

Next, description is made on operation of the printing apparatus in accordance with the present invention.

The printing apparatus in accordance with the present invention is constituted as described above, and therefore a character, symbol or the like corresponding to the inputted data is printed on a print paper by the printing mechanism, and in parallel with this operation, the printed data is stored in the correction memory corresponding to the print position. Also, the present position of the print head is stored in the present position memory corresponding to the print position.

When the searching means receives a relocation command from the inputting means, code data of a character or the like other than the space code is retrieved in sequence from the end address toward the upper address (the direction reverse to the printing direction) of the correction memory, and then, when this searching means detects code data of a character or the like, the data representing that address is outputted to the controlling means from the searching means, and the controlling means relocates the print head to the print position corresponding to the address lower by one character than the address where code data or a character or the like is first detected based on the data of that address and the data of the present position memory.

The printing apparatus in accordance with the present invention, as is described above, is constituted in a manner that code data of a character or the like is retrieved in sequence by searching from the end address toward the upper address of the correction memory without providing the correction register storing the relocation position, and a relocation position is obtained from the address where the code data of the character or the like is first detected, therefore the memory capacity can be reduced by the amount required for the relocation register.

Also, when the searching means receives a relocation command signal from the inputting means, the relocation position is retrieved as described above only when relocation is required, no relocation position is required to be retrieved when no relocation is performed.

Accordingly, the burden of the CPU (central processing unit) of the controlling apparatus is alleviated and the processing time in the CPU is shortened.

DESCRIPTION OF THE DRAWINGS

FIG. 2 is a perspective view of an electronic typewriter.

FIG. 3 is a plan view of a keyboard.

FIG. 4 is a block diagram of a controlling apparatus of the typewriter.

FIG. 5 is an explanatory view schematically exemplifying relationships among a printed word, print position and data in the correction memory.

FIGS. 6(*a*) and (*b*) are a flowcharts showing a routine of relocation control for relocating the print head.

DESCRIPTION OF THE PREFERRED EMBODIMENT

Hereinafter, description is made on an embodiment wherein the present invention is applied to an electronic typewriter with reference to the drawings.

Figure 1:
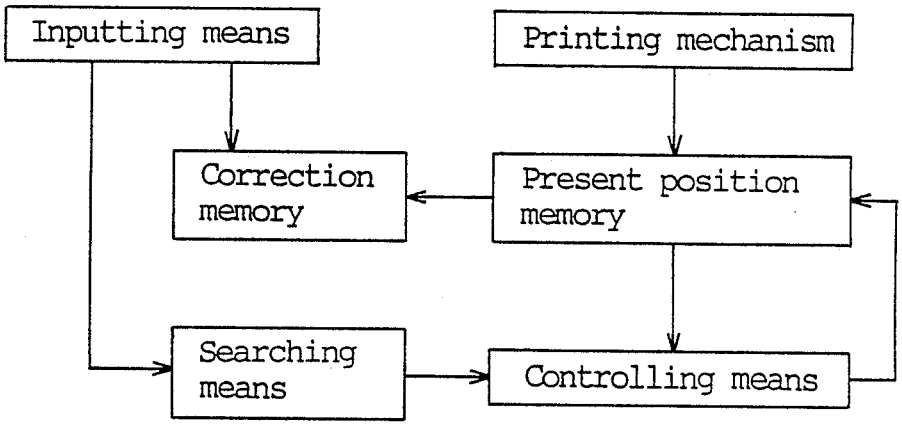
FIG. 1 is a functional block diagram showing a constitution in accordance with the present invention.
Figure 2:
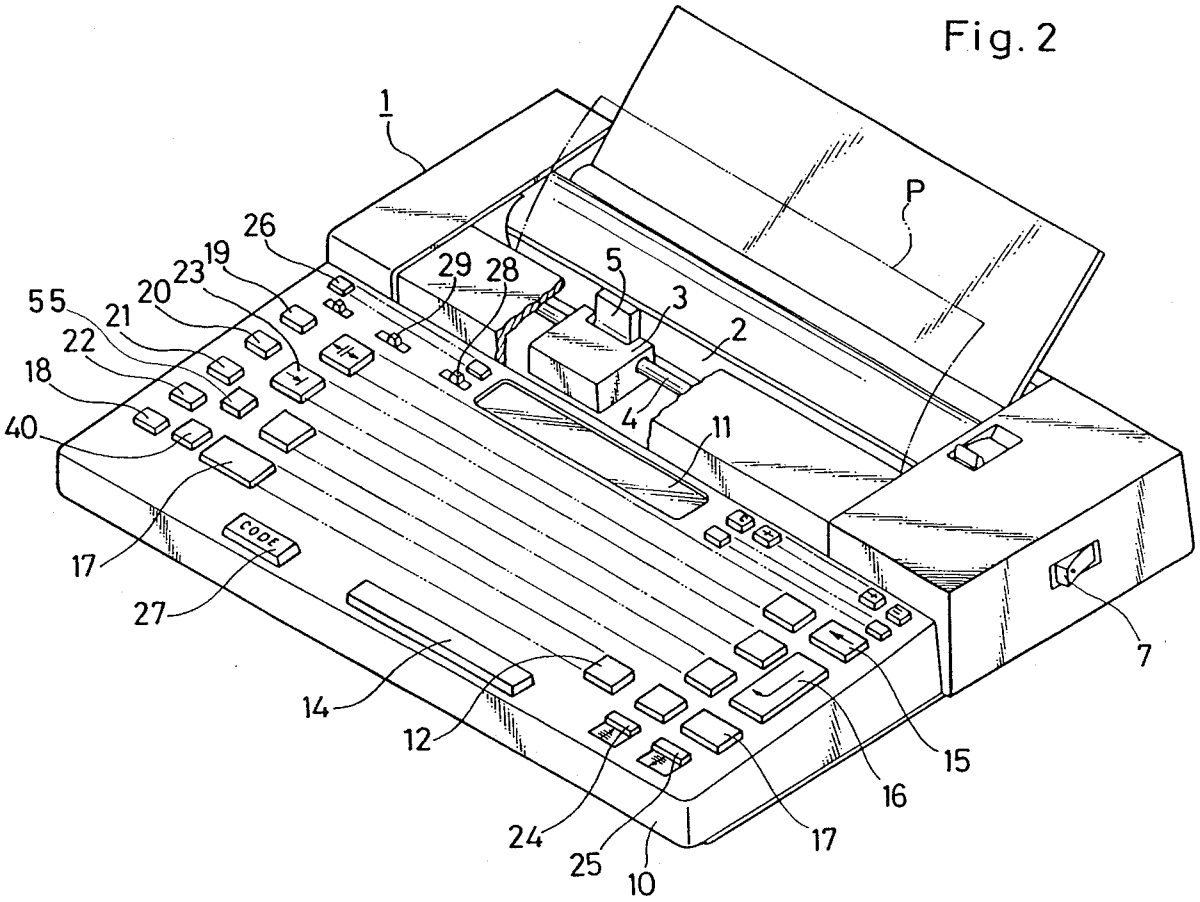
FIG. 2 through FIG. 6 show an embodiment of the present invention.
Figure 3:
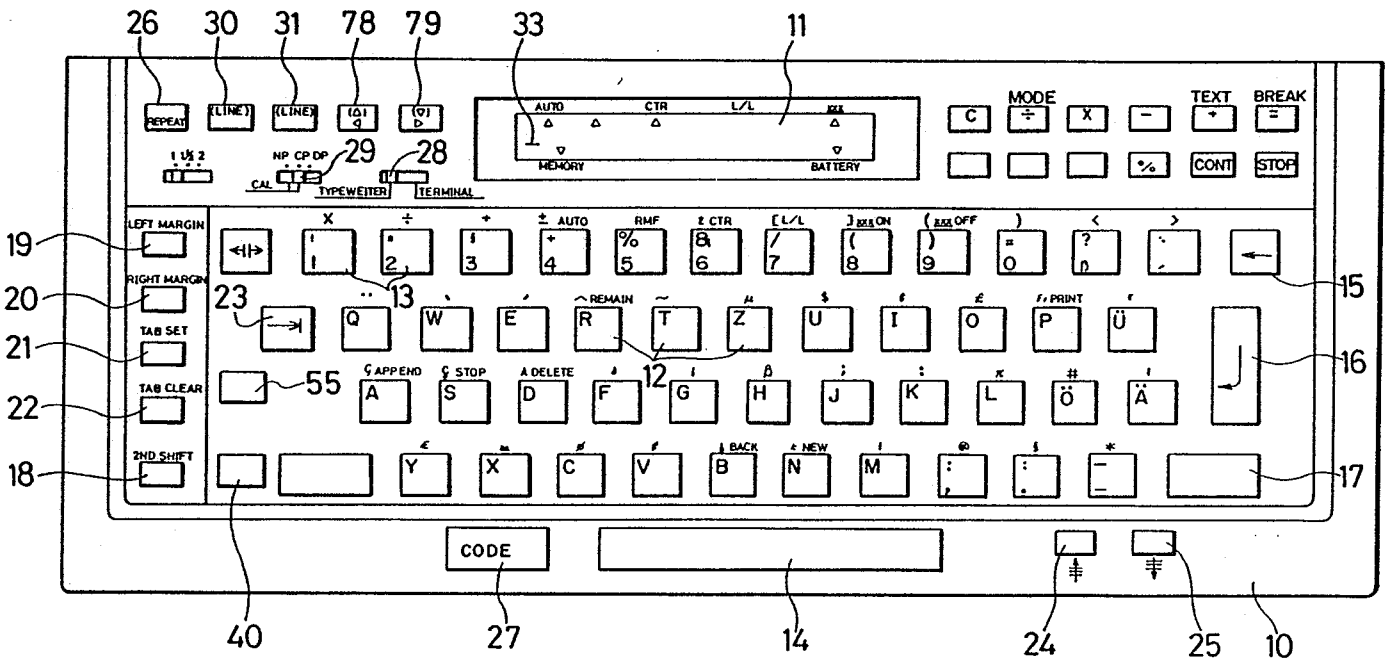

As shown in FIG. 2, a platen 2 is supported at the rear side part of a main unit case 1 of a typewriter, and a guide rod 4 extending in parallel with the platen 2 is disposed in front of it. A carriage 3 is supported on this guide rod 4 in a manner capable of moving right and left along the platen 2. A thermal head 5 is attached to the carriage 3, and the thermal head 5 is changed-over between the print position where the thermal head 5 is pushed against a print paper P in front of the platen 2 and the non-print position where the head 5 is parted forward from the print paper P.

Also, a keyboard 10 is installed in front part of the main unit case 1, and a liquid crystal display (LCD) 11 which is 15 digits shorter than one line is installed on the keyboard 10.

Furthermore, the following operating members for operating the typewriter such as various keys and changeover switches are disposed on the keyboard 10. These are character-symbol keys comprising alphabet keys 12, and numeral keys 13, and a space key 14, a backspace key 15, a carriage return key 16, a shift key 17, a second shift key 18, a left margin st key 19, a right margin set key 20, a tab set key 21, a tab clear key 22, a tab key 23, a paper feed key 24, a paper return key 25, a repeat key 26, a code key 27, first and second mode select switches 28 and 29, an insert key 30, a delete key 31, cursor move keys 78 and 79 for moving a cursor 33 indicating the data input position on the display 11, an erase command key 40 outputting an erase signal, a relocating key 55 moving the thermal head 5 to the original print position wherefrom character printing is continued when a wrongly printed character is corrected.

In addition, description on the other keys is omitted because they are provided in the normal typewriter.

Also, as to a carriage feeding mechanism which moves the carriage 3 having the thermal head 5 right and left in a reciprocative fashion and a ribbon feeding mechanism which is incorporated in the carriage 3, their constitutions are the same as those shown in the Japanese Patent (unexamined) No. 60-87085, and a thermal transfer ribbon R is taken up by a take-up spool by rotation of the take-up spool when the thermal head 5 moves in the printing direction at printing, but when moving the thermal head 5 in the direction reverse to the printing direction, the take-up spool is prevented from rotating by making the thermal head 5 retreat to the non-print position. In addition, description on the concrete configurations thereof are omitted because they are the same as those of the normal typewriter.

Figure 4:
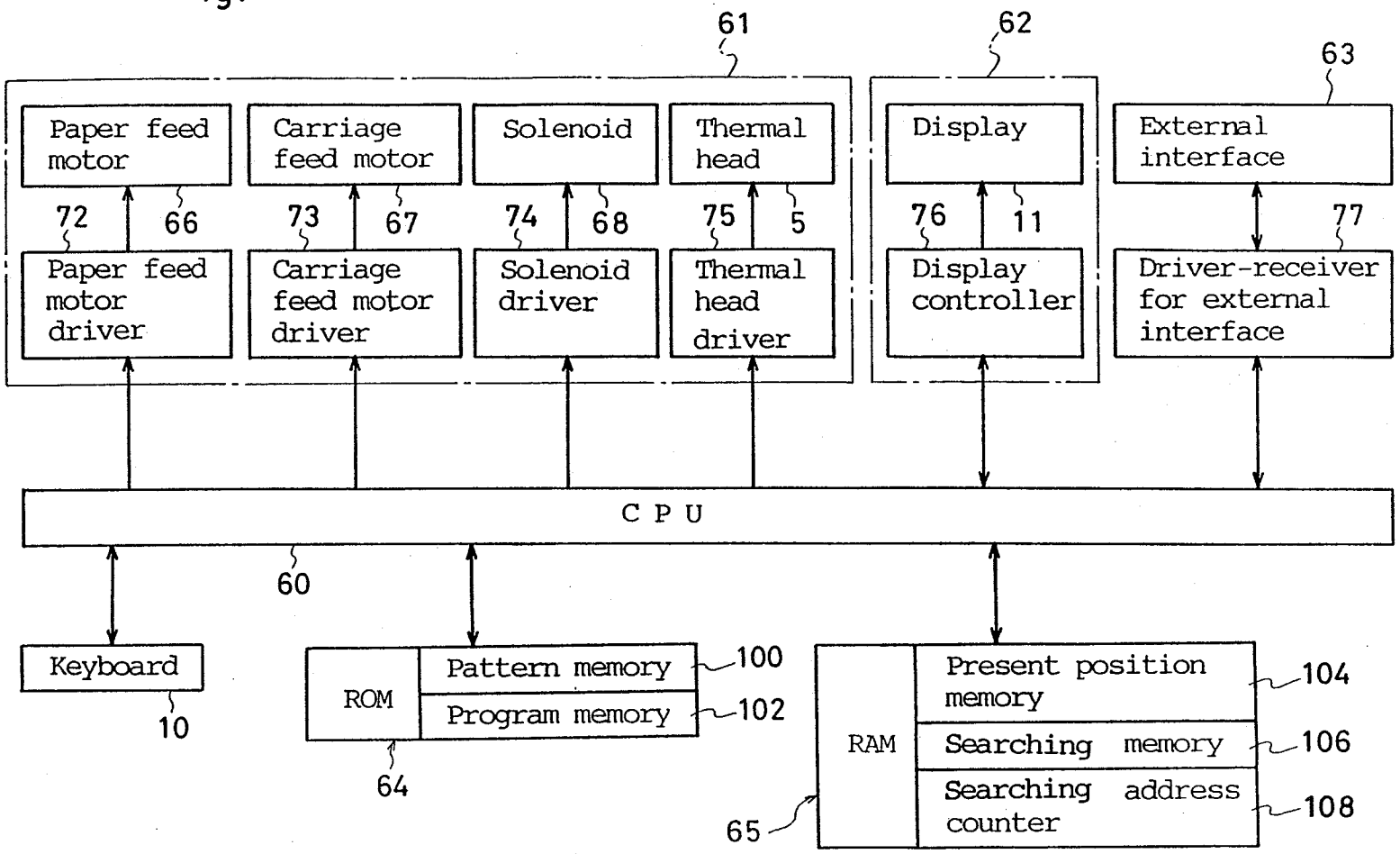

Next, description is made on the controlling apparatus of the above-mentioned typewriter in reference to the block diagram of FIG. 4.

A printing mechanism 61, a displaying mechanism 62, a driver-receiver 77 for external interface connected to an external interface 63, the keyboard 10, a ROM (read only memory) 64 and a RAM (random access memory) 65 are connected to a CPU (central processing unit) 60 as illustrated.

The printing mechanism 61 is provided with a paper feed motor 66 driving a paper feed roller, a paper feed motor driver 72, a carriage feed motor 67 moving the carriage 3, a carriage feed motor driver 73, a solenoid 68 selectively changing-over the thermal head 5 between the print position and the non-print position, a solenoid driver 74, the thermal head 5, a thermal head driver and the like.

The display mechanism 62 is constituted with the display (liquid crystal display) 11 and a display controller 76.

Also, the ROM 64 provides a pattern memory 100 storing pattern data of characters, symbols and the like and a program memory 102 storing a control program for controlling the printing mechanism 61 and the displaying mechanism 62, a control program for controlling the relocation position as described later and the like.

The RAM 65 is provided with a present position memory (print position pointer) 104 storing at least the present position of the thermal head 5 correspondingly to the print position where printing ia made on the print paper P, a correction memory (line memory) 106 storing code data inputted from the keyboard 10 correspondingly to the print position, a seaching address counter 108 for searching code data written to the correction memory 106 in sequence on an address basis, various temporary memories required for controlling the printing mechanism 61 and the displaying mechanism 62 and the like.

The above-mentioned CPU60 stores code data corresponding to characters and symbols such as alphabet, numerals and space inputted through the character-symbol keys on the keyboard 10 in the correction memory 106 of the RAM 65, and reads out the pattern data corresponding to these code data in sequence from the pattern memory 100 of the ROM64, outputting them to the thermal head driver 75 and the carriage feed motor driver 73.

Furthermore, the CPU60 processes the code data inputted from various function keys on the keyboard 10 by the control program read from the program memory 102 of the ROm64, and thereby outputs the control signal corresponding to the input code data to the paper feed motor driver 72, the carriage feed motor driver 73, the solenoid driver 74 and the display controller 76.

Then, the thermal transfer ribbon R is similar to the one as shown in the Japanese Patent Application No. 60-219762, that is, the one which can be used not only as a print ribbon but also a correction ribbon, and next description is made on operation of erasing a wrongly printed character.

When erasing a wrongly printed character, the operator moves the thermal head 5 to the print position where wrong printing has been made through the backspace key 15 or the like and operates the erase command key 40, and thereby the CPU60 controls the printing mechanism 61 by processing the data from the present position memory 104 and the correction memory 106 of the RAM65 by a predetermined control program to print the same character as the wrongly printed character facing the thermal head 5 in a manner of superposing on the wrongly printed character. Then the ink of the wrongly printed character on the print paper P is peeled off the print paper P and is transferred to the thermal transfer ribbon R side, and thereby the wrongly printed character is erased. Then, the correct character is reprinted at the corrective printing.

At the same time, the CPU 60 erases or corrects the data in the correction memory 106 corresponding to each erased or corrected character for erasure or correction of each printed character.

Then, the present invention is characterized by the relocation position control for moving the thermal head 5 to the print continuing position (relocation position) for continuing printing characters after the character printed with wrong spelling has been erased or corrected, and description is made on an outline of this relocation position control to easily understand explanation of the flowchart.

Figure 5:
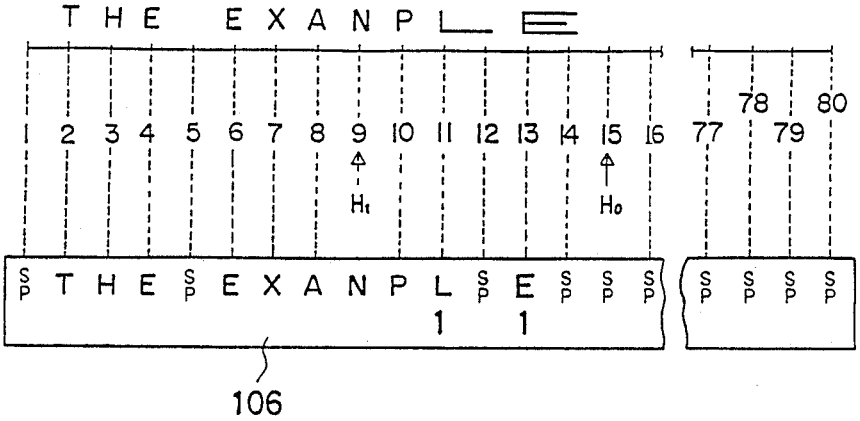

FIG. 5 visually exemplifies a character string printed with wrong spelling "THE EXANPLE" and data in the correction memory 106 as one example. Spaces are types at the first digit and the fifth digit of the print position, and "L" and "E" are printed by the double-width characters, and the thermal head 5 is positioned at the 15th digit (Ho). On the other hand, the code data corresponding to the printed character is written to the position (address) corresponding to the printed character in the correction memory 106.

Here, an address in the correction memory 106 corresponding to the first digit of print position is assumed as an address A1, an address corresponding to the second digit as an address A2—an address corresponding to the 80th digit as an address A80 (endmost address).

Then, the code data of "L" and the data showing the double-width character (for example, 1) are written to the address A11 corresponding to the double-width character "L" at the 11th digit in the correction memory 106, and a space (SP) is written to the address A12, and to the address A13 and the address A14 corresponding to the double-width character "E" at the 13th digit, writing a performed likewise the above-mentioned. Also, the space codes are written to the address A15—the address A80 not printed yet.

In the case where, to correct the wrongly printed character "N" in the above-mentioned case, the wrongly printed character "N" is corrected to "M" by the abovementioned correcting operation by moving the thermal head 5 to the 9th digit (H1) and thereafter printing is continued by moving the thermal head 5 to the relocation position (Ho) at the 15th digit, a relocation command signal is outputted to the CPU 60 by operating the relocation key 55.

In the CPU60, code data of each address is retrieved in sequence while going upstream from the end address A80 of the correction memory 106 based on the relocation control program stored in the program memory 102 of the ROM64, and when a code data other than the space code is first detected, an address An of the memory wherein the code data is stored (in this case, An=13) is obtained, and when that character is a double-width character, an address (An+2) obtained by adding two to the address An is set as a relocation address An, and the thermal head 5 is moved to the print position at the 15th digit corresponding to the relocation address An.

Also, in the CPU60, when the first detected code data other than the space code is of a normal width character, an address (An+1) obtained by adding one to the address An is set as a relocation address An, and the thermal head 5 is moved to the print position corresponding to that relocation address An.

Accordingly, printing can be continued from the original position after this relocation.

Figure 6:
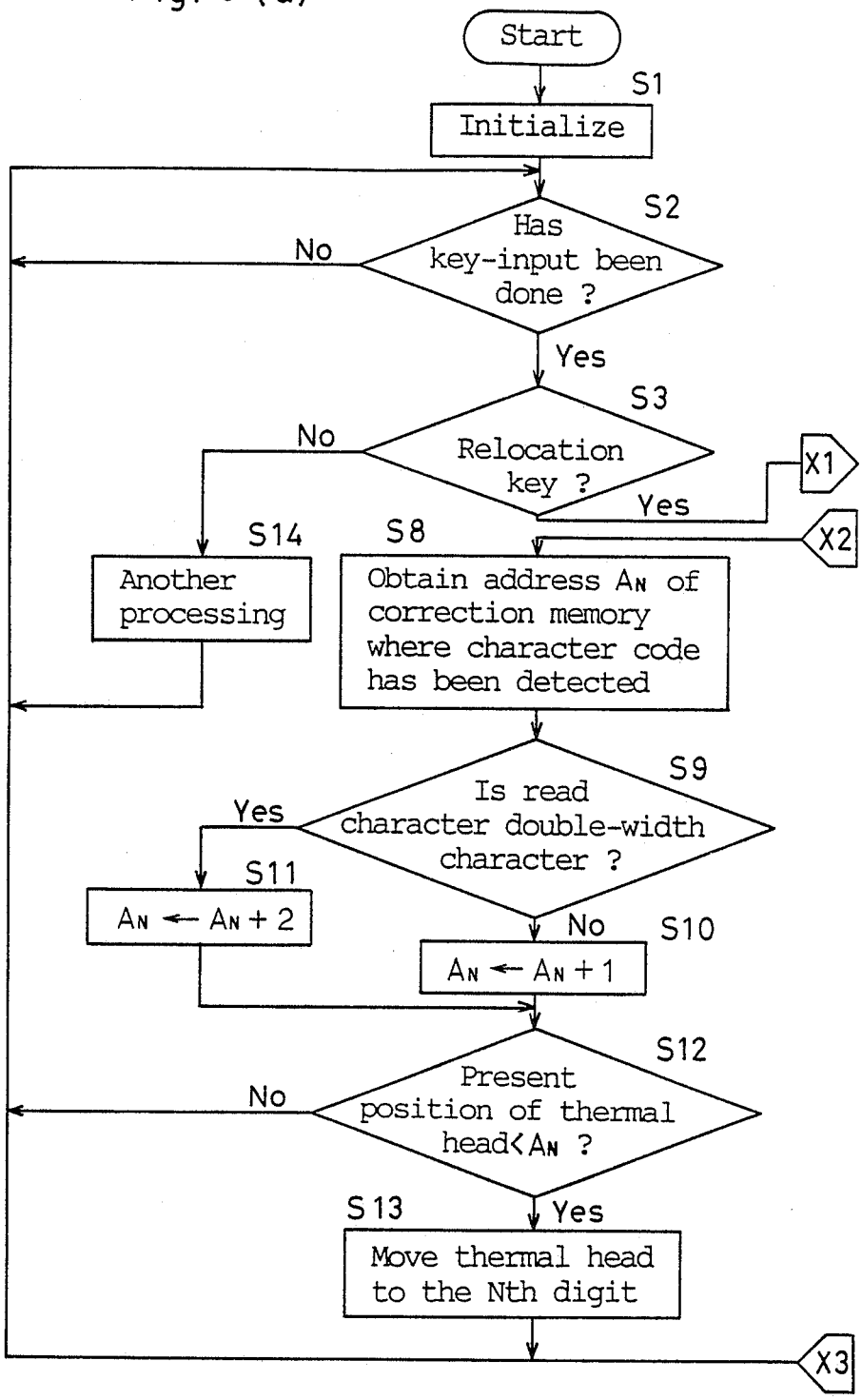
Figure 6:
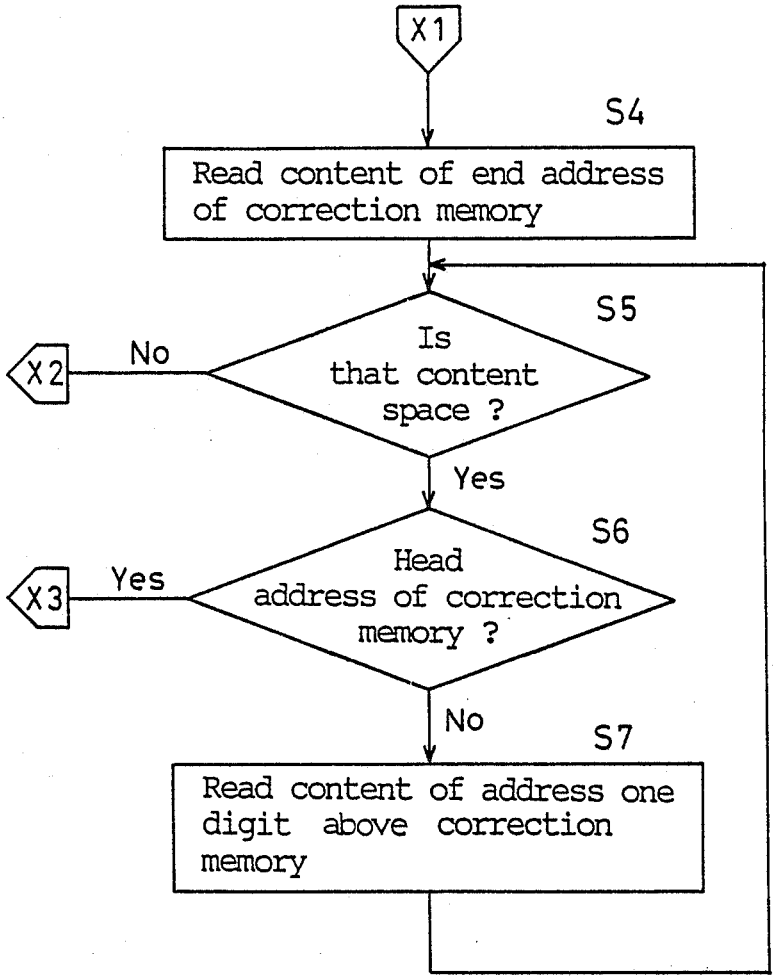

Next, description is made on a flowchart of relocation control performed in the controlling apparatus of the above-mentioned electronic typewriter in reference to FIG. 6(*a*) and FIG. 6(*b*).

When the power switch of the typewriter is turned on, this control is started, and initialization in step S1 (hereinafter represented simply as S1, and the same is true of the other steps) is performed, and the space code is written to all addresses of the correction memory 106, and subsequently S2 is executed.

In S2, decision is made on whether or not a key input has been done (a key has been operated), and when no key is operated, S2 is repeated every small time until a key is operated, and when the key is operated, processing moves to S3.

In S3, decision is made on whether or not the relocation key 55 has been operated in S2, and when the relocation key 55 has been operated, processing moves to S4, and when the relocation key 55 is not operated, processing moves to S14, and character printing or character erasure is executed in response to the code data through the operated key, or when a function key is operated, another processing such as processing corresponding to that function key is executed, and processing returns to S2.

In S4, the endmost address is set in a searching address counter 108 indicating an address to be retrieved, and the code data of the end address of the correction memory 106 in the RAM 65 indicated by the searching address counter 108 is read. Then, in the following S5, decision is made on whether or not the code data in S4 is space code, and when it is the space code (for example, in FIG. 5, the space code is written to the 15th digit—the 80th digit where characters are not printed yet), processing moves to S6, and when not the space code (for example, when the code data of "E" is detected at the 13th digit of FIG. 5), processing moves to S8.

In S6, decision is made on whether or not the address of the correction memory 106 now under retrieval is a head address (address A1 corresponding to the first digit of FIG. 5) based on the data of the searching address counter 108, and when it is a head address, that is, when no characters are printed on that line, processing returns to S2. Also, when it is not a head address, in the next S7, code data of an address one digit upper from or above the address now under retrieval (in the direction reverse to the printing direction) is read by subtracting one from the address value of the searching address counter 108, and processing returns to S5.

Accordingly, when the space code is written to a plurality of addresses, S5–S7 are repeated every quickly, and when a code data other than of space is first detected in S5, processing moves from S5 to S8.

In S8, by reading the data of the searching address counter 108, the address An of the correction memory 106 when a code data other than of space is first detected is obtained, and in the next S9, decision is made on whether or not the detected character is a double-width character based on the data indicating a double-width character of the correction memory 106, and when it is a double-width character, processing moves to S11, and when not a doublewidth character, processing moves to S10.

In S10, an address An obtained by adding one to the address An obtained in S8, that is, the relocation address An corresponding to the print position for moving the thermal head 5 is obtained, and processing moves to S12.

Also, in S11, an address An obtained by adding two to the address An obtained in S8, that is, the relocation address An corresponding to the print position for moving the thermal head 5 is obtained (for example, "E" at the 13th digit of FIG. 5 is a double-width character, and therefore the relocation position becomse the 15th digit), and processing moves to S12.

In S12, based on the data of the present position memory 104 of the RAM65, decision is made whether or not the value of digit of the present position of the thermal head 5 is smaller than the value of digit of the position corresponding to the address An obtained in S10 or S11, that is, whether or not the position of the thermal head 5 is located at the print position upper from the relocation position (direction reverse to the printing direction), and when the thermal head 5 is located at the print position upper from the relocation position, processing moves to S13, and when the thermal head 5 is located at the print position lower from the relocation position (printing direction), processing returns to S2.

In S13, the thermal head 5 is moved to the print position of the Nth digit corresponding to the relocation address An obtained in S10 or S11, and processing returns to S2. In this movement, the CPU60 outputs a control signal to the carriage feed motor driver 73 of the printing mechanism 61 based on the the value of the relocation address An and the data of the present position memory 104.

As described above, after the erasing or correcting operation of a wrongly printed character has been performed, the thermal head 5 is moved to the print continuing position (relocation position) for continuing character printing by operating the relocation key 55.

In addition, in the above-mentioned embodiment, description is made on the thermal typewriter provided with the thermal printer, but is is needless to say that the present invention is applicable likewise also to the typewriter provided with the digital wheel type printer or the type ball type printer.

What is claimed is:

1. A relocating control system for a printing apparatus having a printing mechanism for printing characters corresponding to inputted data from inputting means; a memory having a memory area between a first address and a second address for storing plural character code data of printed characters in sequence from the first address corresponding to respective print positions; and a present position memory for storing a present position of a print head of the printing mechanism; said relocating control system comprising:

searching means, responsive to a relocation command signal from said inputting means, for determining in sequence from said second address toward said first address whether each of said code data stored in said memory is said character code data or said non-print code data, and for determining that na address storing a first determined character code data is a final address; and controlling means for relocating said print head of said printing mechanism to a print position corresponding to an address which is closer to said second address than said final address is, based on a determination of said searching means and said present position stored in said present position memory.

2. A relocating control system according to claim 1, wherein said memory stores non-print code data representative of information other than said printed characters in addresses where said character code data have not been stored.

3. A relocating control system according to claim 1, wherein said controlling means relocates said print head to a print position corresponding to an address which is one address closer to said second address than said final address.

4. A relocating control system according to claim 1, wherein said printing mechanism further prints an enlarged character, and said memory stores said character code data including size information which indicates that said character code data is representative of the enlarged character when said printing mechanism prints the enlarged character.

5. A relocating control system according to claim 4, wherein said controlling means further includes determining means for determining character code data stored in said final address include said size information, and said controlling means relocates said print head to a print position corresponding to an address which is one address closer to said second address than said final address when said determining means determines that said character code data does not include said size information and relocates said print head to a print position corresponding to another address a plurality of addresses closer to said second address than said final address is when said determining means determines that said character code data includes said size information.

6. A relocation control system according to claim 5, wherein said size information is enlarged size flag data stored in an address corresponding to a print position where said enlarged character is printed.

7. A relocating control system according to claim 5, including means, based on size information, for storing a prescribed number of space code data in sequence from an address which is one address closer to said second address than an address is where said character code data including said size information are stored when said determining means determines that said character code data include said size information.

8. A relocating control system according to claim 7, wherein said enlarged character is enlarged in a print sequence direction.

9. A relocating control system according to claim 8, wherein said enlarged character is a double-wide character.

10. A relocating control system according to claim 9, wherein said prescribed number of space code data is one and said controlling means relocates said print head to a print position corresponding to an address which is two addresses closer to said second address than said final address is.

11. A relocating control system for a printing apparatus having a printing mechanism for printing characters corresponding to inputted data from inputting means; a memory having a memory area between a first address and a second address for storing plural character code data of printed characters in sequence from the first address corresponding to respective print positions and for storing non-print code data representative of information other than said printed characters in addresses where said character code data have not been stored; and a present position memory for storing a present position of a print head of the printing mechanism; said relocating control system comprising:

searching means, respective to a relocation command signal from said inputting means, for determining, in sequence from said second address toward said first address, whether each of said code data stored in said memory is said character code data or said non-print code data, and determining a final address which has stored a first determined character code closest to said second address; and controlling means for relocating said print head of said printing mechanism to a print position corresponding to an address which is one address closer to said second address than said final address is.

12. A relocating control system for a printing apparatus having a printing mechanism for printing characters corresponding to inputted data from an inputting means; and a present position memory for storing a present position of a print head of the printing mechanism, said relocating control system comprising:

a memory having a memory area between a first address and a second address for storing plural character code data of printed characters in sequence from a first address corresponding to respective print positions, and for storing size information indicating an enlarged character incidental to said character code data when said printing mechanism prints said enlarged character which is enlarged in its width in a print sequence direction, and for storing a prescribed number of space code data in sequence from an address which is one address closer to said second address when said character code data has said size information, and for storing non-print code data representative of information other than said printed characters in addresses where said character code data have not been stored;

searching means, responsive to a relocation command signal from said inputting means; for determining, in sequence from said second address toward said first address, whether each of said code data stored in said memory is said character code data or said non-print code data, and determining a final address which has stored a first determined character code closest to said second address; and controlling means for determining whether said character code data stored in said final address include said size information, and relocating said print head to a print position corresponding to an address which is one address closer to said second address than said final address is when said controlling means determines said character code data does not include said size information, and relocating said print head to a print position corresponding to another address which is a plurality of addresses closer to said second address than said final address is when said controlling means determines that said character code data includes said size information.

* * * * *